US011680779B2

(12) United States Patent
Dunning et al.

(10) Patent No.: US 11,680,779 B2
(45) **Date of Patent: *Jun. 20, 2023**

(54) TRAP MACHINE WITH A SPRING MANIPULATION MECHANISM

(71) Applicant: Bushnell Inc., Overland Park, KS (US)

(72) Inventors: Joe Dunning, Oroville, CA (US); Christopher Bird, Oroville, CA (US); Michael Courpet, Oroville, CA (US); Aaron Taylor, Oroville, CA (US)

(73) Assignee: Bushnell Inc., Overland Park, KS (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/902,047

(22) Filed: Sep. 2, 2022

(65) Prior Publication Data

US 2022/0412703 A1 Dec. 29, 2022

Related U.S. Application Data

(63) Continuation of application No. 17/199,372, filed on Mar. 11, 2021, now Pat. No. 11,441,879.

(51) Int. Cl.
*F41J 9/20* (2006.01)
*F41J 9/24* (2006.01)

(52) U.S. Cl.
CPC ..... *F41J 9/24* (2013.01)

(58) Field of Classification Search
CPC ..... F41J 9/18; F41J 9/20; F41J 9/24
USPC ..... 124/6, 7, 8, 16, 43
See application file for complete search history.

(56) References Cited

U.S. PATENT DOCUMENTS 956,117 A * 4/1910 Lord ..... F41J 9/32 124/43
1,071,512 A * 8/1913 Davey ..... F41J 9/20 248/183.3
1,162,118 A * 11/1915 Wilder ..... F41J 9/20 124/43
1,495,349 A * 5/1924 Olin ..... F41J 9/20 124/36
1,564,884 A * 12/1925 North ..... F41J 9/20 124/32
1,663,780 A * 3/1928 Spangler ..... F41J 9/20 124/32
1,771,865 A * 7/1930 Spangler ..... F41J 9/20 248/185.1
1,819,567 A * 8/1931 North ..... F41J 9/20 124/43

(Continued)

OTHER PUBLICATIONS

International Search Report and Written Opinion, dated Jun. 10, 2022, in related International Application No. PCT/US22/19810.

*Primary Examiner* — Alexander R Niconovich
(74) *Attorney, Agent, or Firm* — Walter M. Egbert, III; Richard J. Brown; Reed Smith LLP

(57) ABSTRACT

A trap machine that launches clay targets, and the trap machine has a tensioning spring having a first end and a second end, the first end operatively connected to a motor assembly and the second end engaged to a first end of a threaded bolt the tensioning spring providing tension on a nut on the bolt against the rear of the housing; and a lever configured to releasably engage the threaded bolt and move the threaded bolt against the bias of the tensioning spring thereby releasing tension of the nut against the rear of the housing.

17 Claims, 14 Drawing Sheets

(56) References Cited

U.S. PATENT DOCUMENTS 2,011,830 A * 8/1935 Sherman ..... F41J 9/20 248/183.3
2,025,903 A * 12/1935 Roth ..... F41J 9/20 43/84
2,078,166 A * 4/1937 Schwerin ..... F41J 9/20 124/43
2,135,603 A * 11/1938 Roth ..... F41J 9/20 124/32
2,158,739 A * 5/1939 Bingham, Jr. ..... F41J 9/20 124/40
2,193,266 A * 3/1940 Betts ..... F41J 9/20 124/8
2,925,077 A * 2/1960 Luebkeman ..... F41J 9/20 124/43
2,925,812 A * 2/1960 Foster ..... F41J 9/20 124/43
2,996,058 A * 8/1961 Ervine ..... F41J 9/30 124/43
3,119,383 A * 1/1964 Foster ..... F41J 9/32 124/47
3,179,101 A * 4/1965 Luebkeman ..... F41J 9/20 124/43
3,368,542 A * 2/1968 Dale ..... F41J 9/20 124/43
3,420,218 A * 1/1969 Rademacher ..... F41J 9/20 124/43
3,470,860 A * 10/1969 Kane ..... F41J 9/20 124/36
3,601,112 A * 8/1971 Dale ..... F41J 9/20 124/80
3,677,257 A * 7/1972 Segerkvist ..... F41J 9/30 124/43
3,971,357 A * 7/1976 LaPorte ..... F41J 9/24 124/43
4,481,932 A * 11/1984 Olson ..... F41J 9/20 124/43
6,062,207 A * 5/2000 Underhill ..... F41J 9/20 124/8
6,176,229 B1 * 1/2001 Patenaude ..... F41J 9/18 124/8
7,263,986 B2 * 9/2007 Lovell ..... F41J 9/30 124/9
9,389,050 B1 * 7/2016 Chen ..... F41J 9/30
9,605,931 B2 3/2017 Laporte et al.
9,835,421 B2 12/2017 Laporte et al.
10,458,760 B1 * 10/2019 Liu ..... F41J 9/20
10,545,011 B1 * 1/2020 Collins ..... F41J 9/18
10,746,513 B1 * 8/2020 Liu ..... F41J 9/24
2006/0065258 A1 3/2006 Lovell
2015/0168108 A1 * 6/2015 Laporte ..... F41J 9/20 124/7
2016/0327379 A1 * 11/2016 Laporte ..... F41J 9/18
2019/0154412 A1 * 5/2019 Laporte ..... F41J 9/20

* cited by examiner

TRAP MACHINE WITH A SPRING MANIPULATION MECHANISM

CROSS REFERENCE TO RELATED APPLICATION

This application claims the benefit of U.S. application Ser. No. 17/199,372, filed Mar. 11, 2021, now issued as U.S. Pat. No. 11,441,879, the disclosure of which is incorporated by reference herein.

TECHNICAL FIELD

The present disclosure relates to a trap machine that launches clay targets, and more particularly, relates to a trap machine that allows selective release of tension in the main spring of the machine.

BACKGROUND

Trap machines are target throwing devices for shooting sports whether using a rifle, a gun or even a bow, with such targets being in the form of clay saucers or discs and are conventionally used to shoot sporting clays, skeet, and trap.

Sporting clays involves shooting clay targets at various locations which are launched at different velocities and angles, i.e., across the shooter's view, towards the shooter, or away from the shooter. This experience closely resembles actual hunting conditions since the sporting clays can be shot to resemble quail, pheasants, doves, and other game birds, as well as high-flying ducks or geese. Thus, it is more difficult for shooters to become accustomed to the shots as they might for trap or skeet shooting.

Skeet shooting involves shooting clays which are flung into the air at high speed and is meant to simulate the action of bird hunting. In one conventional arrangement, the shooter can be positioned along a semi-circle connecting two launching stations, a high house target and a low house target. The high house target launches the target from a point up to 10 feet above ground, and the low house target launches the target from a point up to 3 feet off above ground.

Trap shooting involves shooting clays which are launched from a single launching location, namely, a trap house positioned at a distance in front of the shooter, at varying angles within a range of 45 degrees to the left or right of a center position from the trap house. The shooter rotates to several different positions relative to the trap house.

Whether for shooting sporting clays, skeet, or trap, a conventional trap machine has a spring-loaded throwing arm for launching the clays.

Conventional trap machines do not allow for ease of adjustment and removal of main spring. With current designs, the adjustment nut is always under spring tension after initial assembly. If the intent is to remove the main spring for transport/storage, it would take a significant amount of time because the nut is always under constant spring tension, requiring significant torque to remove the adjustment nut. Due to the difficulty in the adjustment and removal after assembly the throwers are generally stored with the spring under tension.

Since the spring is not completely removed and is under tension, the stored energy in the tensioned spring presents a safety hazard. For instance, the spring tension means that the throwing arm is held away from the housing of the machine and can be damaged during transport. There is also the potential for the throwing arm to fire accidentally.

Furthermore, conventional trap machines are difficult to maintain. Keeping the spring under tension also causes excessive friction on the nut and main spring bolt threads, which can cause undesired wear and potentially premature failure. When parts become worn due to the vibration of the trap machine when releasing and launching the clays, major components must be replaced, and often, the user will replace the entire machine rather than replace the major components of the trap machine.

It is desirable to develop a trap machine that allows for easy release of tension on the main spring to allow for improved safety and reduced wear of parts of the trap machine.

SUMMARY OF THE DISCLOSED SUBJECT MATTER

A clay target launching machine, according to one aspect of the present disclosure, comprises a motor assembly; a throwing arm operatively coupled to the motor assembly such that actuation of the motor assembly is translated into pivoting of the throwing arm to launch a clay target; a housing that supports, at least in part, the motor assembly and the throwing arm; a tensioning spring having a first end and a second end, the first end operatively connected to the motor assembly and the second end engaged to a first end of a threaded bolt, wherein the first end of the threaded bolt is configured to be engaged by a lever, and a second end of the threaded bolt passes through a hole in the rear of the housing and engages the rear of the housing with a nut engaged to the threaded second end of the threaded bolt; and further comprising a lever having a first end configured to releasably engage the threaded bolt and engage a fulcrum on the housing and a second end comprising a handle; and the lever is configured to pivot about the fulcrum from a first position to a second position.

Embodiments of the clay target throwing machine include the following, alone or in any combination.

The clay target launching machine wherein when the lever is engaged to the first end of the threaded bolt and moved from the first position to the second position, the tensioning spring is extended and tension between the threaded bolt and the rear of the housing is reduced, allowing for the nut to be moved distally along the threaded bolt and disengaged from the rear of the housing.

The clay target launching machine wherein when nut has been moved distally along the threaded rod and the lever is returned to its first position, the spring is not under tension.

The clay target launching machine wherein when the first end of the lever is not engaged to the threaded bolt, it is configured to engage a fitting on a wheeled cart supporting the housing to provide a handle for moving the wheeled cart.

The clay target launching machine wherein the first end of the threaded bolt comprises two projections on opposed sides of the first end and the first end of the lever is configured to releasably engage the two projections on opposed sides of the first end of the threaded bolt.

The clay target launching machine wherein the first end of the lever comprises two projections, each having a hook configured to engage one of the two projections on the first end of the threaded bolt.

The clay target launching machine wherein the threaded bolt comprises a flat side that does not comprise threads.

The clay target launching machine wherein the threaded bolt comprises one or more positions on the threaded bolt configured that when the nut is positioned at the one or more positions, the spring is under tension and the tension is proportional to a desired distance for the throwing arm to throw the clay target.

The clay target launching machine wherein when the spring is not under tension, the throwing arm is configured to be rotated and engaged to a rod attached to the housing so that the throwing arm is disposed and held within the housing.

The clay target launching machine wherein the nut comprises a knurled handle or a speed ball handle.

The clay target launching machine that includes a magazine containing a predetermined number of clay targets.

In another aspect, provided is a method for reducing tension in a tensioning spring of a clay target throwing machine, the method comprising:

providing a clay target throwing machine as described above, including any embodiments disclosed herein;

engaging the first end of the lever to the first end of the threaded bolt and the fulcrum on the housing at a first position;

moving the lever from the first position to a second position, thereby extending the tensioning spring and reducing tension between the threaded bolt and the rear of the housing, allowing for the nut to be moved distally along the threaded bolt and disengaged from the rear of the housing; and moving the lever from the second position back to the first position, thereby reducing tension in the tensioning spring.

Embodiments of the method include the following.

The method further comprising disengaging the first end of the lever from the threaded bolt and the fulcrum on the housing.

The method further comprising rotating the throwing arm so that the throwing arm is disposed within the housing.

The method further comprising engaging the throwing arm to a rod attached to the housing so that the throwing arm is held within the housing.

BRIEF DESCRIPTION OF THE DRAWINGS

The foregoing and other features of the present invention will be more readily apparent from the following detailed description and drawings of the illustrative embodiments of the invention wherein like reference numbers refer to similar elements and in which.

DETAILED DESCRIPTION OF THE DISCLOSED SUBJECT MATTER

The present disclosure relates to a trap machine that launches clay targets, and more particularly, relates to a trap machine that allows selective release of tension in the main spring of the machine. However, it will be understood that the machine as described herein can be used for shooting various types of objects for other purposes. The inventive concepts of the present disclosure can be incorporated into various types of launchers so that they become easy to maintain, structurally stable and safe, able to accurately time the release of the launched object with the swing of a propelling member, e.g., an arm that launches the object.

A clay target launching machine, according to one aspect of the present disclosure, comprises a motor assembly; a throwing arm operatively coupled to the motor assembly such that actuation of the motor assembly is translated into pivoting of the throwing arm to launch a clay target; a housing that supports, at least in part, the motor assembly and the throwing arm; a tensioning spring having a first end and a second end, the first end operatively connected to the motor assembly and the second end engaged to a first end of a threaded bolt, wherein the first end is configured to be engaged by a lever, and a second end of the threaded bolt passes through a hole in the rear of the housing and engages the rear of the housing with a nut engaged to the threaded second end of the threaded bolt; and further comprising a lever having a first end configured to releasably engage the first end of the threaded bolt and engage a fulcrum on the housing and a second end comprising a handle; and the lever is configured to pivot about the fulcrum from a first position to a second position.

Figure 1:
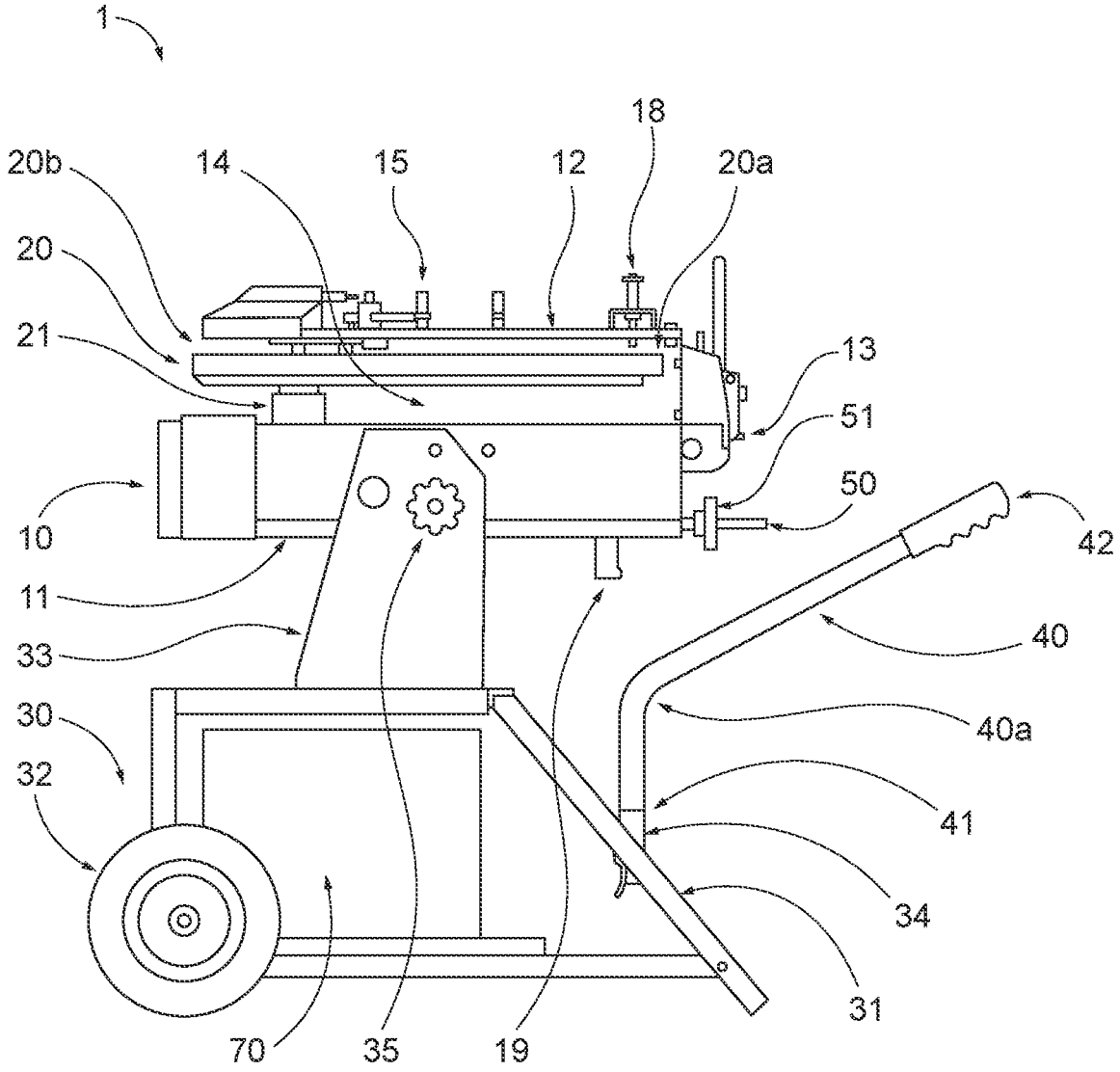
FIG. 1 is a side view of a trap machine, according to an exemplary embodiment of the disclosed subject matter.

FIG. 1 is a side view of a trap machine 1, according to an exemplary embodiment of the disclosed subject matter. The trap machine 1 comprises a housing 10, comprising a lower body 11. Lower body 11 generally consists of a box comprising a closed front end and open top and bottom that contains an electric motor (not shown) in operable connection with throwing arm 20, a tensioning mechanism including a spring (not shown) and a motor with one-way clutch bearing (not shown) to transfer energy from the motor and the spring to the throwing arm. The housing 10 also comprises a rear panel 13 that extends above the lower body 11 and supports top panel 12. The upper edge of lower body 11, the rear panel 13 and the top panel 12 define a slot 14 in which throwing arm 20 rotates through to receive a clay target and throw it downfield. Throwing arm 20 comprises a long distal end 20*a* and a short proximal end 20*b* and pivots or rotates about an axle within pivot 21 that is connected to the motor by a drive shaft. The top panel 12 comprises a magazine mount 15 for installation of a magazine for holding clay targets (see FIGS. 5 and 6). Also shown is a restraining pin 18 that can extend through top panel 12 and engage the throwing arm 20 to hold it within the housing 10 when the spring is disengaged, as discussed further below. Extending below the housing lower body 11 is a bar 19 that provides a fulcrum for a lever 40 to selectively engage the tensioning mechanism and release tension, as discussed further below.

Typically, the entire trap machine 1 is supported by and carried on a frame or cart 30 such that it can be easily moved from one location to another location. The trap machine 1 shown comprises a cart 30 comprising a lower framework 31, wheels 32 and an upper framework 33 that supports housing 10. For example as shown in FIG. 1, the lower framework 31 can be in the form of rails that are connected at one end thereof to a pair of wheels 32 to permit the entire machine 1 to be moved. The cart 30 also comprises a fitting 34 that engages first end 41 of lever 40 to hold it in a storage configuration. Lever 40 also comprises a second end 42 comprising a handle. Lever 40 also comprises a bend 40*a*. In the storage configuration lever 40 is configured as a steering device to lift the rear of cart 30 and steer the cart 30 to a location by a user grasping handle 42. Upper framework 33 comprises a knurled knob 35 engaged to a rod that extends through upper framework 33 into housing lower body 11 to adjust the elevation tilt of the housing 10 from essentially horizontal to an elevation angle of 0-50 degrees. Optionally, upper framework 33 can swivel relative to lower framework 31 to adjust the horizontal direction that a clay target is thrown by the machine.

Optionally, auxiliary actuators can be used to elevate and/or swivel the housing to change the throwing angle for a throw to provide a more varied shooting experience. The optional actuators can be controlled by a user to change the vertical and/or horizontal orientation the trap machine to adjust the trajectory of a throw. In some embodiments, the optional actuators can be controlled by a processor in the control module of the trap machine that can change the throwing angle after one or more shots randomly or according to a specified sequence.

Threaded bolt 50 extends through a hole in the rear panel 13 to engage a tensioning spring of the tensioning mechanism (not shown) and is held in place by a nut in knurled knob 51. Also shown in FIG. 1 is a battery 70 that provides power to the motor.

Figure 2:
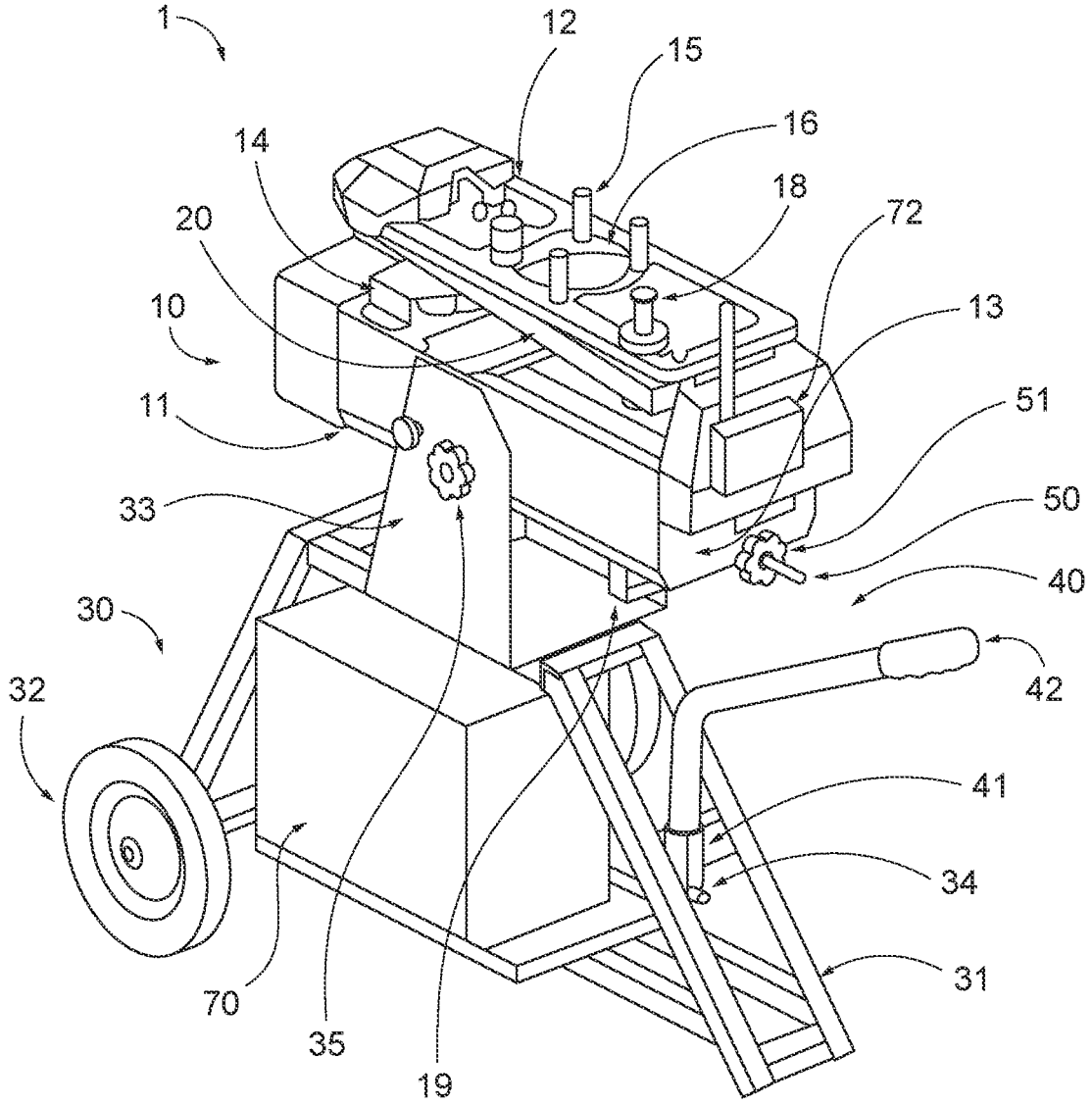
FIG. 2 is a rear perspective view of a trap machine, according to an exemplary embodiment of the disclosed subject matter.

FIG. 2 is a rear perspective view of a trap machine 1, according to an exemplary embodiment of the disclosed subject matter. An opening 16 in top panel 12 allows a clay target to pass from the magazine (not shown) onto the throwing arm 20. Shown attached to rear panel 13 is a control module 72 that contains controls and circuitry to operate the trap machine 1.

Figure 3:
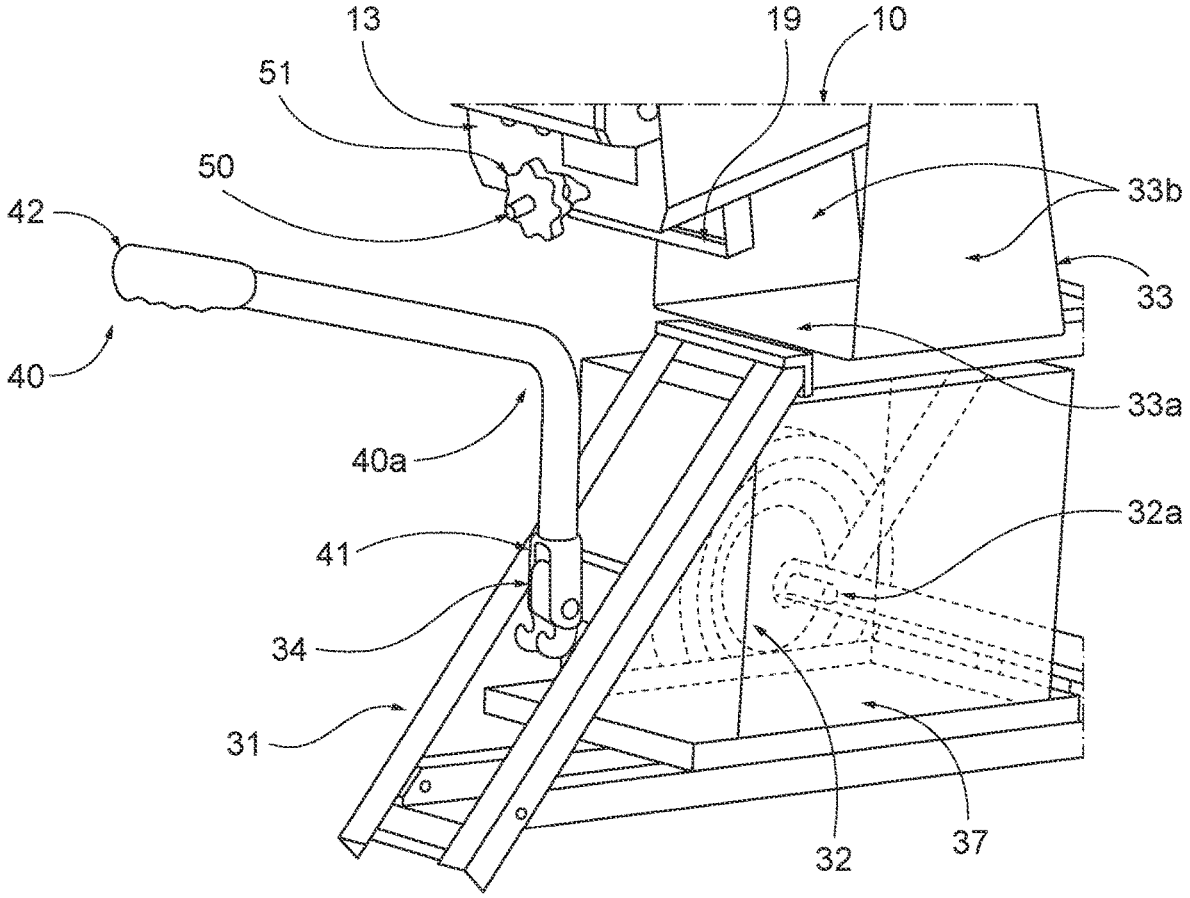
FIG. 3 is a close-up rear perspective view of a trap machine, according to an exemplary embodiment of the disclosed subject matter.

FIG. 3 is a close-up rear perspective view of a trap machine 1, according to an exemplary embodiment of the disclosed subject matter. In this view, housing 10 is shown in a non-horizontal elevated configuration. Wheel 32 is shown engaged to the lower framework 31 by an axle 32*a*. Upper framework 33 comprises a horizontal panel 33*a* and vertical panels 33*b* extending above opposed sides of the horizontal panel 33*a*. Shelf 37 on lower framework 31 is configured to support the battery 70 and other equipment.

Figure 4:
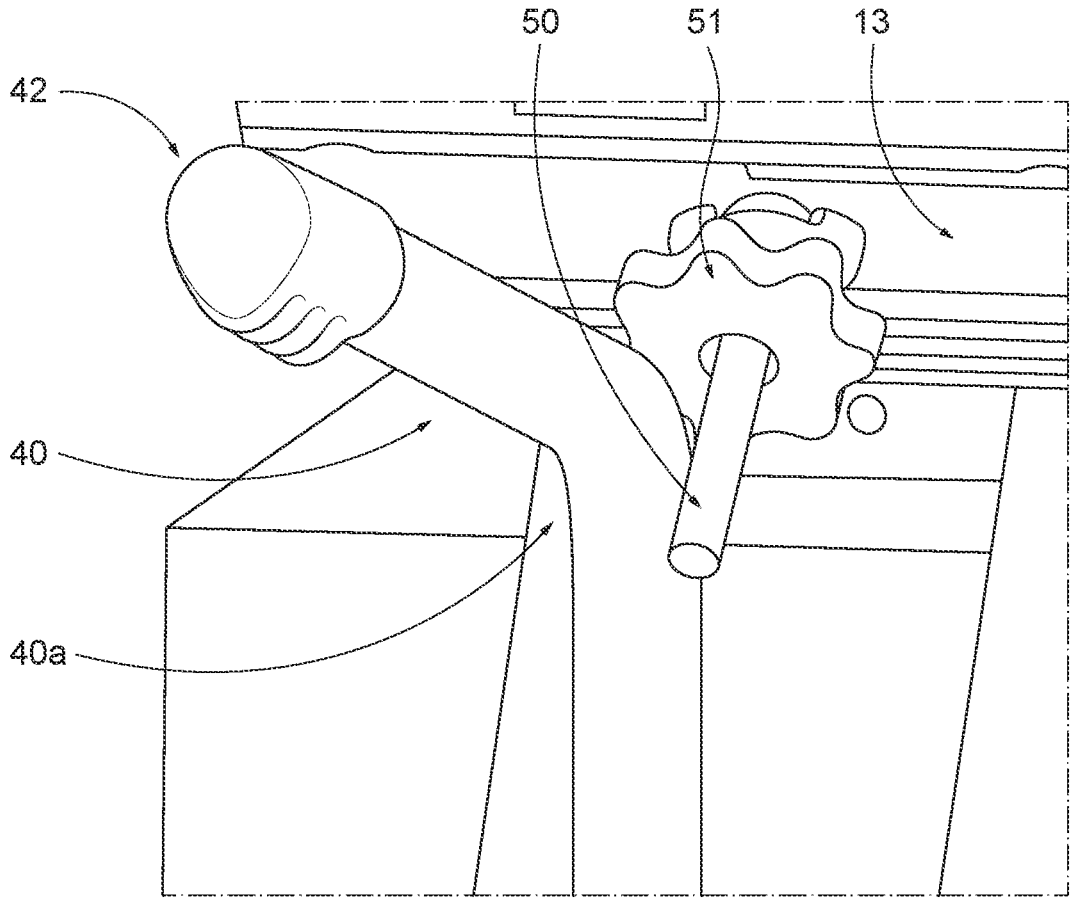
FIG. 4 is a close-up rear view of a trap machine, according to an exemplary embodiment of the disclosed subject matter.

FIG. 4 is a close-up rear view of a trap machine, according to an exemplary embodiment of the disclosed subject matter. In the embodiment shown, lever 40 is held in its storage position off-center relative to the rear panel 13 of the housing to minimize interaction between lever 40 and threaded bolt 50 and knurled knob 51.

Figure 5:
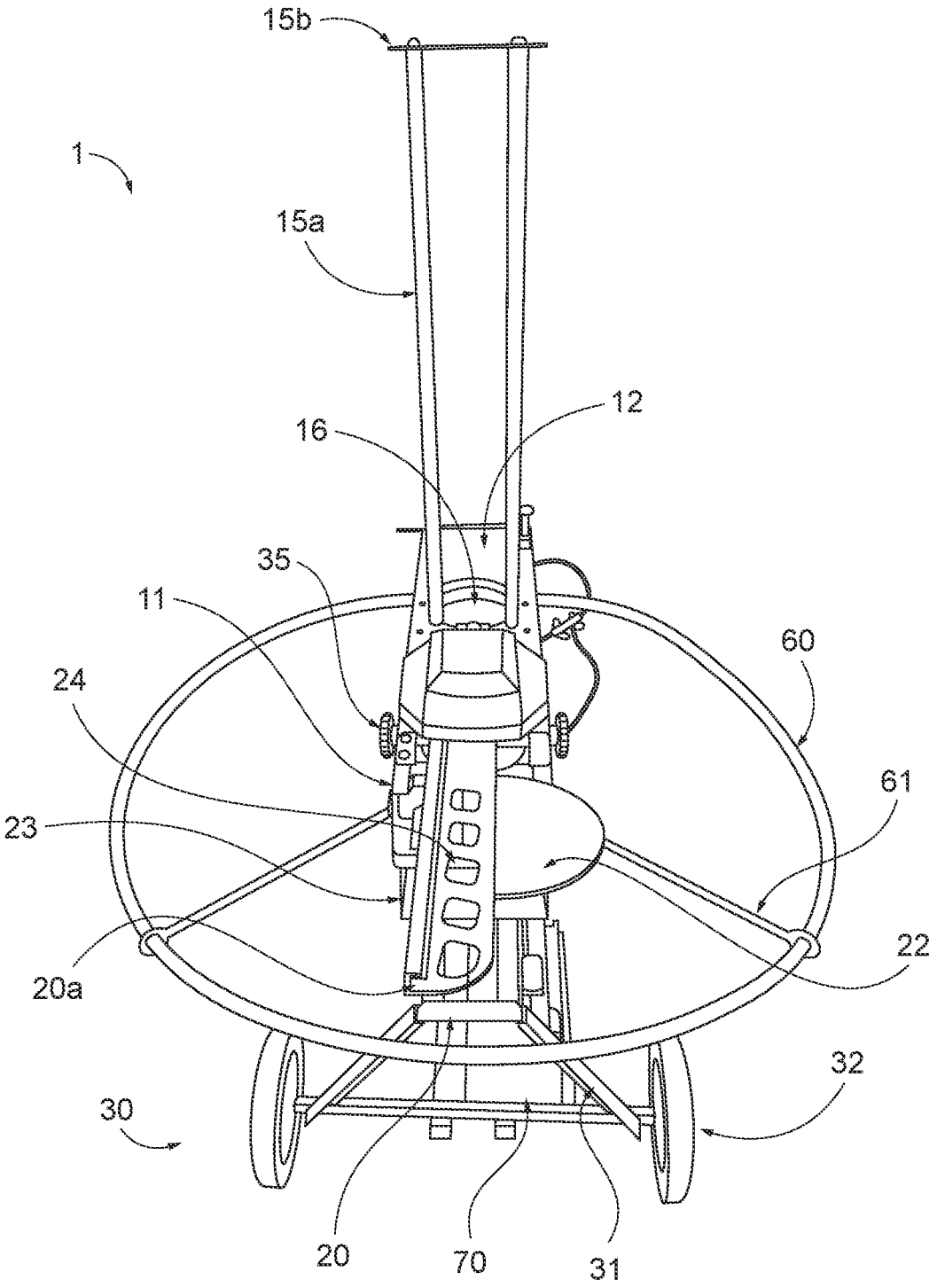
FIG. 5 is a top front perspective view of a trap machine, according to an exemplary embodiment of the disclosed subject matter.

FIG. 5 is a top front perspective view of a trap machine, according to an exemplary embodiment of the disclosed subject matter. This view shows a magazine comprising four uprights 15*a* mounted at their bottom ends to top panel 12 positioned in a generally square pattern in the magazine, and their top ends attached to an open ring 15*b*. A stack of a plurality of clay target discs can be loaded into the magazine nested between uprights 15*a*. The magazine may typically store up to 80 clays in a single stack, although some magazines comprise a plurality of stacks, such as two, three or four stacks. The top panel 12 serves as a support surface for the magazine and includes an opening, e.g., clay release hole 16, formed therethrough to permit passage of a clay target from the magazine to the throwing arm 20.

A ring 60, typically comprising hollow flexible tubing, can be attached to housing 10 and supported by frame rods 61 and provides a visual indicator of the path of the throwing arm 20 during operation of the trap machine 1. This safety feature warns a user to stay away from the path of the throwing arm 20. When viewed from above, the throwing arm rotates counterclockwise once during each throw. In the view shown in FIG. 5, throwing arm 20 is shown extending forward (at a 12 o'clock position) with the tensioning spring detached. When the arm is at 12 o'clock, a user can thread the nut in knurled knob 51 on the threaded bolt 50 until it contacts the back of the trap machine at real panel 13. This would be the first position to where the trap would not have "spring slap". Throwing arm comprises a distal end 20*a*. A widened area, proximate to the pivot 21, on the leading edge provides a receiver plate 22 that receives a clay target from the magazine via hole 16. A raised flange 23 on the trailing edge of arm 20 comprises an elastomeric surface that engages the edge of the clay target disc when it rests on the receiver plate 22. The distal end 20*a* extends distally from receiver plate 22 and may optionally comprise a plurality of perforations to minimize friction with the bottom surface of a clay target disc.

The arm 20 is articulated about a substantially vertical axis and is fixed to the upper end of a rotating shaft or axle within pivot 21 supported by the housing lower body 11 and extending into top panel 12, with said shaft being free to rotate relative to the housing lower body 11 and top panel 12.

A motor assembly (not shown) including a motor is fixedly mounted inside the housing lower body 11 and controls the actuation and movement of the throwing arm 20. A drive shaft of the motor rotates a drive shaft to rotate the throwing arm 20 engaged to the top of the drive shaft. At the bottom of the drive shaft, an eccentric cam or crank device is engaged to a first end of a coil tensioning spring. The other end of the coil tensioning spring is engaged to threaded bolt 50 inside the housing lower body 11. Rotation of the drive shaft causes the eccentric cam to extend and increase tension in the spring, building latent energy in the spring. A nut engaged to the threaded bolt and engaged to the rear panel 13 of the housing 10 can adjust the amount of initial tension in the spring by moving proximally or distally along the threaded region such that the amount of threaded bolt extending into the housing decreases or increases respectively. When the amount of threaded bolt extending into the housing decreases, the extension of the spring increases. When the nut increases the tension in the spring by extending the spring, the spring resists the rotational motion of the drive shaft. Hence, the torque on throwing arm 20 increases and thereby its speed during a launch when the user turns the nut to extend the spring.

When the amount of threaded bolt extending into the housing increases, the extension of the spring decreases. When the user decreases the tension in the spring by releasing the spring, the spring provides less resistance to the rotation of the drive shaft. Hence, the speed of the throwing arm 20 decreases when the user turns the nut to release the spring.

Accordingly, the amount of maximum tension in the spring during a launch cycle is proportional to a desired throwing distance for a clay target and can be adjusted by the position of the nut on the threaded bolt.

Figure 6:
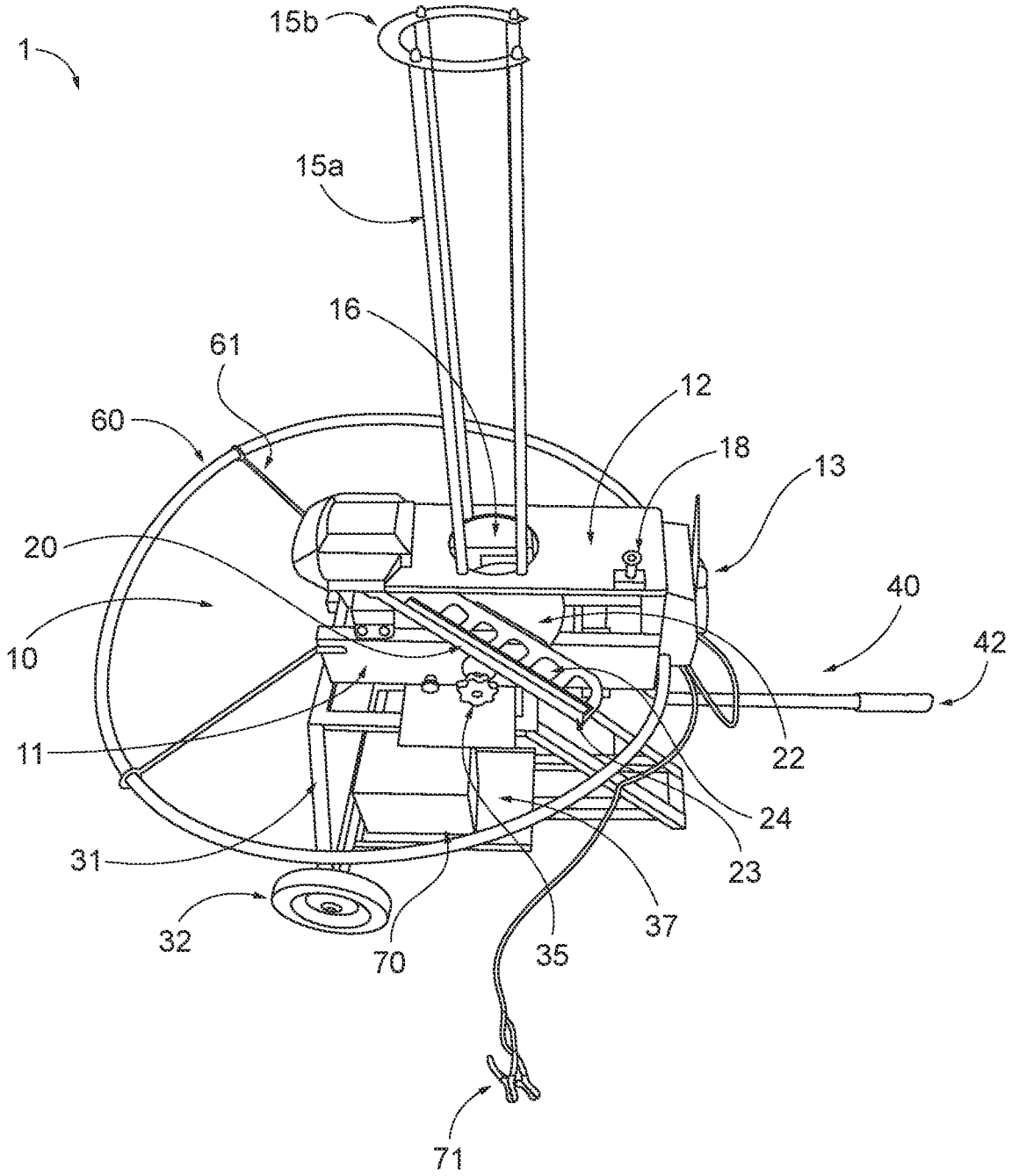
FIG. 6 is a top side perspective view of a trap machine, according to an exemplary embodiment of the disclosed subject matter.

To launch targets after tightening the nut on the bolt 51, a user turns the motor on and it rotates the throwing arm 20 counterclockwise to the position shown in FIG. 6 at about 7-8 o'clock, the so-called "zero point" where a limit (active) switch is activated, stopping the motor from continuing. The throwing arm cannot be stopped at the 12 o'clock position without removing the mainspring assembly.

FIG. 6 is a top side perspective view of a trap machine, according to an exemplary embodiment of the disclosed subject matter. The throwing arm 20 is disposed at the 7 o'clock position, with its leading edge entering the housing 10 such that the receiver plate is positioned below the opening 16 in top panel 12 so that a clay target can be loaded onto the receiver plate from the magazine. The torque on the arm from the tensioning spring is approaching a maximum. Also shown in FIG. 6 is a cable harness 71 configured to attach to the battery and supply power to the motor and the controls of the machine.

The machine 1 also includes a clay target loading assembly that is positioned below the magazine and includes the top panel 12 and a moving gate disposed on an underside of the top panel 12 to load targets from the magazine to the throwing arm. The clay loading assembly is activated by the leading edge of throwing arm 20 engaging a trip mechanism, or by a crank or eccentric cam disposed on the drive shaft below the top panel 12.

The moving gate is slidingly mounted to the underside of the top panel 12. A number of fasteners, such as four shoulder bolts, are slidingly mounted in a corresponding number (e.g., four) of slots in the moving gate and the threaded ends of the shoulder bolts are secured to the top panel 12, either directly or by passing through holes in the top panel 12*a* and screwed into threaded screw holes in plates engaged to the top panel 12. Thus, the moving gate is allowed to slide with respect to the shoulder bolts, which are stationary with respect to the top panel 12.

The top panel 12 includes the opening 16 (clay release hole) through which the clays drop. The clay release hole 16 in the top panel 12 is aligned with the stack of clays (not shown) in the magazine, and the bottommost clay is positioned within the opening 16. The moving gate also includes a second clay release hole. As the moving gate slides with respect to the top panel 12, a clay drops by gravity onto the throwing arm 20 when the clay release holes 16 and second clay release hole in the moving gate, respectively, are aligned. When the clay release holes are aligned, the clay drops to a clay launching position on the receiving plate 22 on throwing arm 20 located below the clay release holes in the gap between the top panel 12 and the lower body 11 of the housing 10.

To initiate the launching of a target, a remote triggering device discussed below commands the motor to turn a drive shaft to rotate the arm 20. During this step, also called the step of cocking, the motor starts to rotate drive shaft counter-clockwise. While rotating counter-clockwise, going past the zero point generates a motor torque on the arm 20 thanks to the extended tension spring. As the arc traversed by the drive shaft increases, the tension on the spring is increased and the amount of torque imparted on the throwing arm increases.

Once the triggering device is triggered, it bypasses the limit switch and allows the motor to move the arm to approximately the 5:55 o'clock position where the spring force is at is strongest tension and takes over. A clay target is loaded as the arm passes through this position, as described below. The spring provides much greater pull force than the motor and the one-way clutch bearing allows the spring to launch the clay until the spring slows to the speed of the motor and the motor will take over and bring the arm back to the zero point, where it will activate the limit switch again stopping the arm.

The throwing arm 20 is cocked each time the main motor rotates through one cycle, i.e., one revolution. The trap machine 1 can be controlled using conventional techniques, including, the user operating a handheld control or a foot pedal including a push button switch to activate the trajectory motor to release the cocked throwing arm 20. Thus, the user can activate the trap machine at a distance from the trap machine using a remote activation device. The handheld control or a foot pedal can be connected to the controller in control module 72 by a wired or wireless connection. However, it will be appreciated that any number of other mechanisms can likewise be used, such as a voice-activated controller.

Tension in the spring continues to increase torque on the arm 20 as it rotates through the target loading region inside the housing until the arm is rotated to the opposite side of the housing (near the 5 o'clock position).

If such torque is not hindered by any obstacle, the tensioning spring then suddenly contracts and the release of the arm 20 causes the launching of the target. During the step of launching, the arm 20 almost instantly rotates due to the contracting action of the tensioning spring and release of torque.

During the launching operation, the arm 20 rotates about its axis and undergoes angular acceleration which presses the clay target against the flange 23 while making the clay target roll towards the distalmost portion of distal end 20*a*. The clay target is then ejected while spinning around. The spin imparted on the clay target during the throwing motion stabilizes its flight. The release of the target from the throwing arm 20 occurs when the throwing arm is at about the 12 o'clock position shown in FIG. 5. Follow-through of the throw brings the arm 20 back to the zero point at the 7:30-8 o'clock position.

As discussed above, conventional trap machines do not allow for ease of adjustment of tension in and/or removal of the main spring. Conventional trap machines provide a speed adjustor for the throwing arm that requires a wrench. With current designs, the adjustment nut is always under spring tension after initial assembly, which can result in decreased safety and increased wear on fine parts of the machine such as the threads on the threaded bolt.

However, the present disclosure provides a more user-friendly design for adjusting tension in the spring, and thereby speed control of the throwing arm. The improved trap machine disclosed herein provides a mechanism and method for selectively releasing tension in the main spring.

The improved trap machine comprises a lever having a first end configured to releasably engage a first end of the threaded bolt and engage a fulcrum on the housing and a second end comprising a handle; and the lever is configured to pivot about the fulcrum from a first position to a second position. When the lever is engaged to the first end of the threaded bolt and moved from the first position to the second position, the tensioning spring is extended and tension between the threaded bolt and the rear of the housing is reduced, allowing for the nut to be moved distally along the threaded bolt and disengaged from the rear of the housing. When the nut has been moved distally along the threaded rod and the lever is returned to its first position, the spring is not under tension.

When the spring is not under tension, tension can be introduced to the spring by engaging the first end of the lever to the first end of the threaded bolt, moving the lever from its first position to its second position, moving the nut proximally along the threaded rod, and returning the lever to its first position; and further disengaging the lever from the first end of the threaded bolt.

Figure 7:
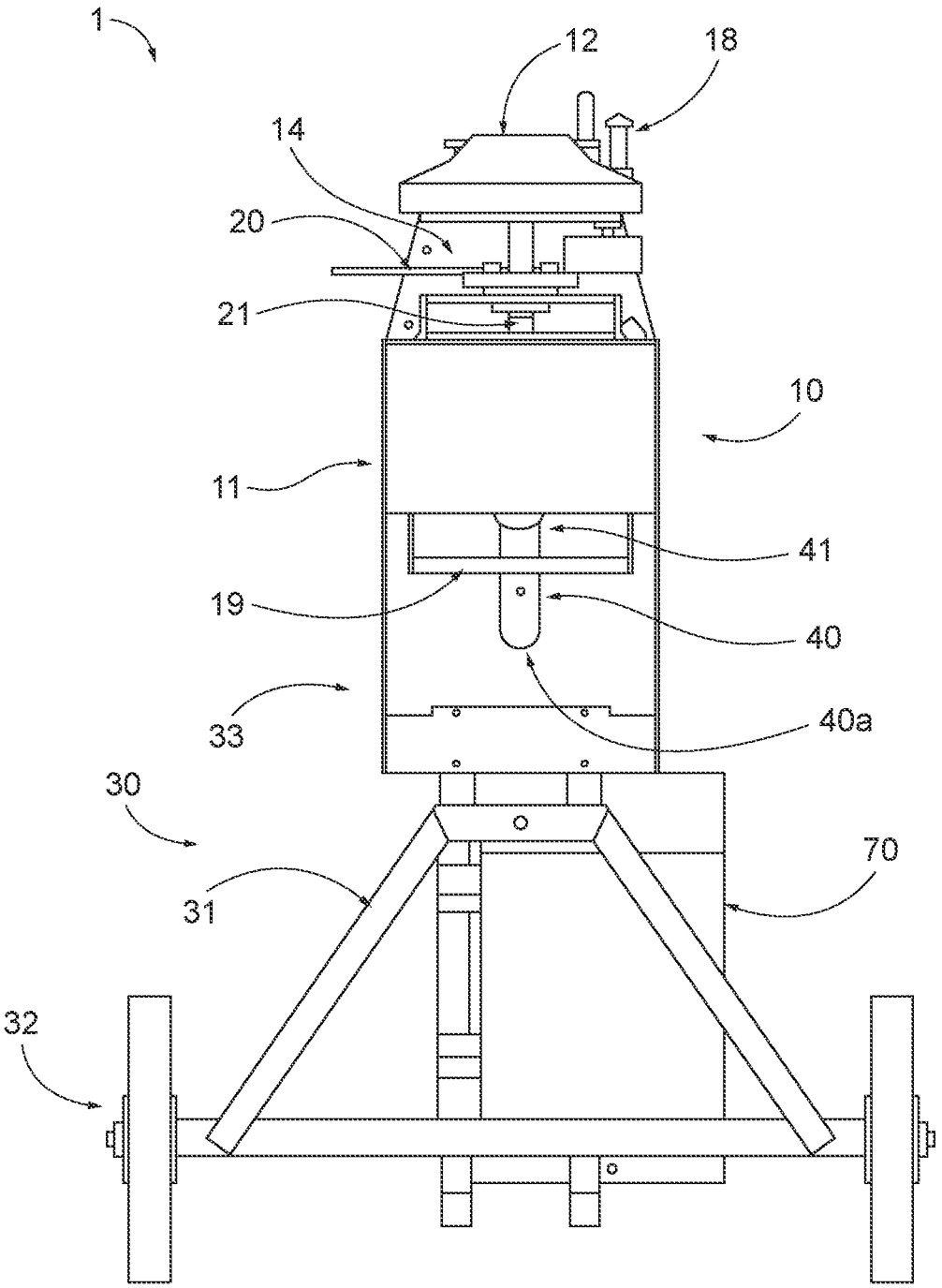
FIG. 7 is a front view of a trap machine, according to an exemplary embodiment of the disclosed subject matter.

FIG. 7 is a front view of a trap machine, according to an exemplary embodiment of the disclosed subject matter. In this view, lever 40 has been disengaged from its storage position and is engaged to bar 19 between bend 40*a* and first end 41, which is engaged to an end of threaded bolt 50 (not shown) inside lower body 11.

Figure 8:
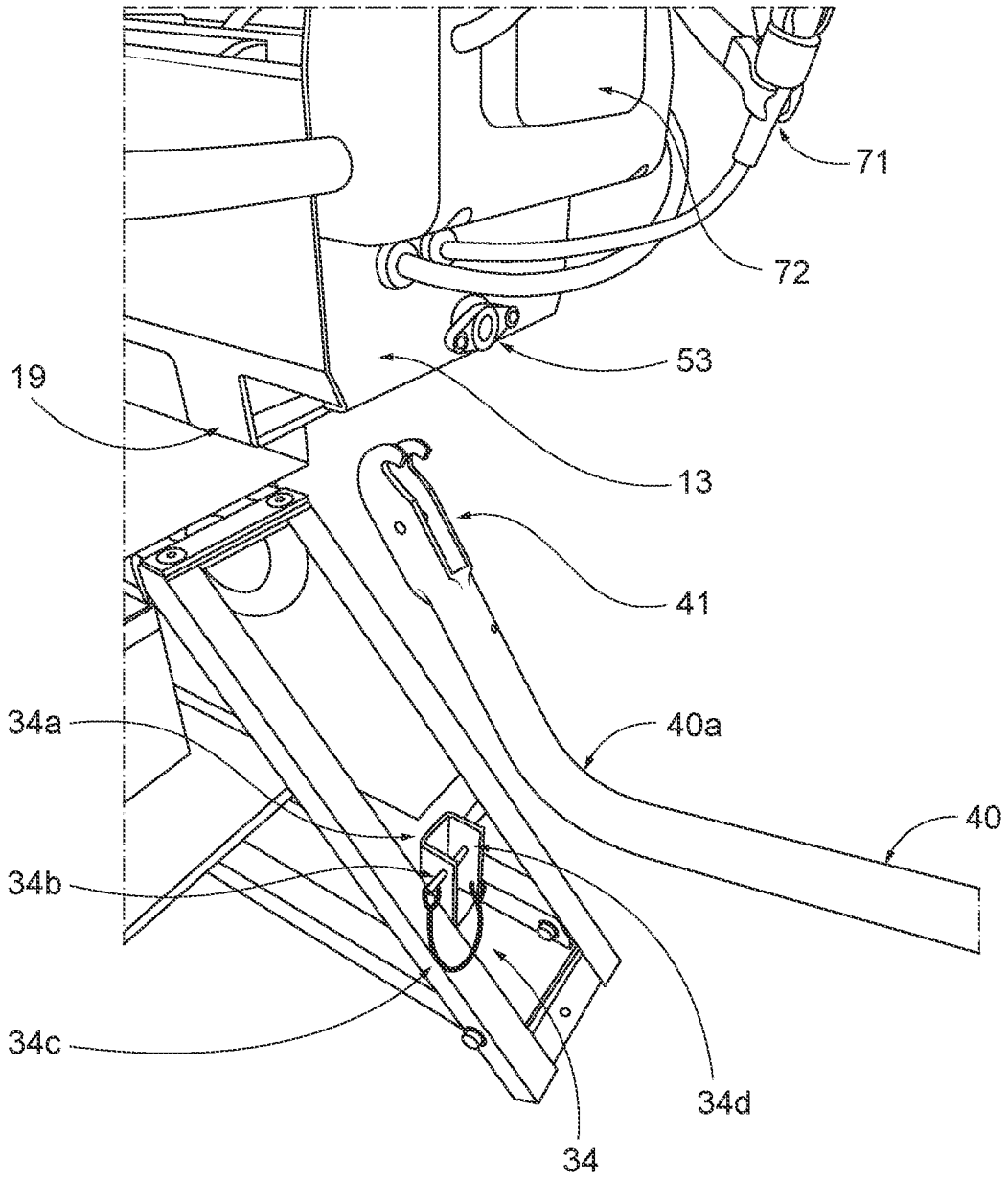
FIG. 8 is a close up rear perspective view of a trap machine showing a lever disengaged from its storage position, according to an exemplary embodiment of the disclosed subject matter.

FIG. 8 is a close up rear perspective view of a trap machine 1 showing lever 40 disengaged from its storage fitting, according to an exemplary embodiment of the disclosed subject matter. The storage fitting 34 comprises a three-sided open box 34*a* configured to engage first end 41 of lever 40, when first end 41 is disposed vertically inside the box 34*a*. Pin 34*b* is attached to box 34*a* by cable 34*c* and is configured to pass through holes 34*d* in opposed sides of box 34*a* and holes 41*c* of lever first end 41 (see FIG. 9) to lock the first end 41 to the fitting 34. FIG. 8 also shows bushing 53 in a hole in the rear panel 13 that threaded bolt 50 (not shown) would pass through to enter the inside of housing lower body 11 to engage the tensioning spring. When one end of the bolt 50 is engaged to the tensioning spring when it is under tension, the bolt 50 is pulled toward the interior of the housing lower body 11 and a nut (not shown) engaged to the threaded segment of the bolt 50 is pulled tightly against bushing 53. This makes adjusting the tension of the tensioning assembly of conventional trap machines difficult without use of a wrench.

Figure 9:
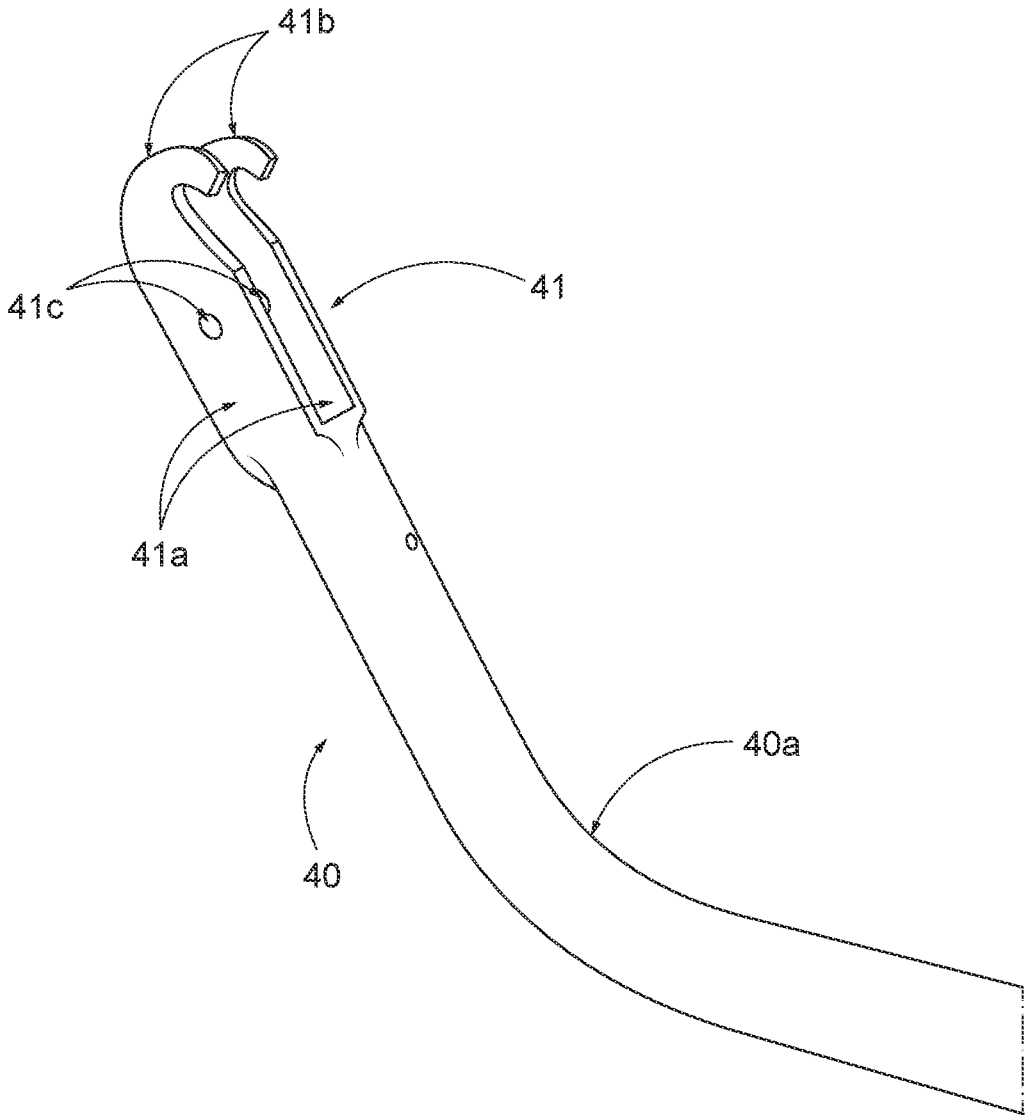
FIG. 9 is a close-up view of one end of a lever of a trap machine, according to an exemplary embodiment of the disclosed subject matter.

FIG. 9 is a close-up view of the first end 41 of lever 40 of the trap machine 1, according to an exemplary embodiment of the disclosed subject matter. First end 41 comprises two flat projections 41*a* on opposed sides of first end 41. Projections 41*a* each comprise hooks 41*b* at their ends. Projections 41*a* each also comprise holes 41*c* that as described above can be engaged with pin 34*b* when first end 41 is disposed vertically inside box 34*a*.

Figure 10:
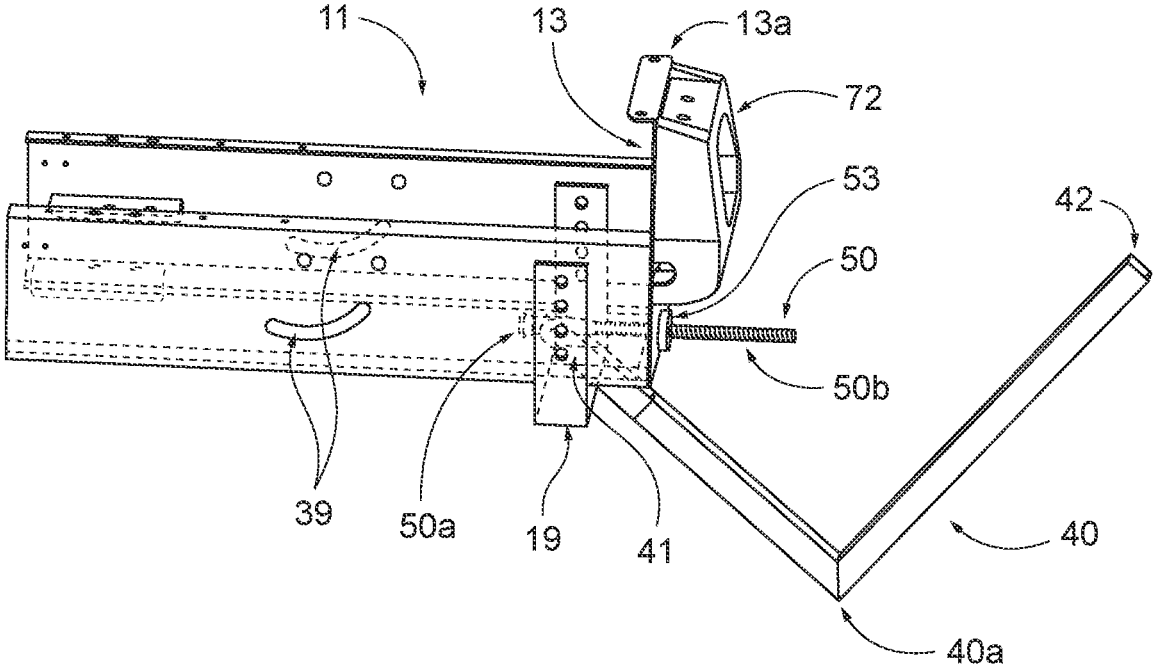
FIG. 10 is a side view of a trap machine showing a lever engaged to a tension bolt in a first position, according to an exemplary embodiment of the disclosed subject matter.

FIG. 10 is a simplified side view of a trap machine 1 according to an exemplary embodiment of the disclosed subject matter, showing lever 40 engaged to tension bolt 50 in a first position. In this view, housing lower body 11 is shown as transparent to allow its interior to be shown. Flange 13*a* and holes therein provides a locus for attaching top panel 12 to rear panel 13 using fasteners such as screws or bolts (not shown). Curved holes 39 in opposed sides of housing lower body 11 engage pins of the elevation adjusting mechanism 35 to adjust the tilt or angle of elevation of the trap machine 1 as discussed with regard to FIG. 1. First end 50*a* of bolt 50 is configured to engage the inner volume of a coil spring (not shown). Threaded region 50*b* passes through bushing 53. In this first position, first end 41 of lever 40 is engaged to bolt 50 proximate to the first end 50*a* in a generally horizontal orientation. Lever 40 engages bar 19 between first end 41 and bend 40*a* proximate to first end 41. In this embodiment shown, bend 40*a* is configured at a greater angle than that depicted in previous Figures. In any embodiments, the bend 40*a* orients the second end 42 of lever 40 at a generally upward angle relative to the trap machine 1 when the lever 40 is in the first position. In the first position, tension force between the spring and the threaded bolt 50 is not relieved and a nut (not shown) would be held tightly against bushing 53, making it difficult to adjust tension.

Figure 11:
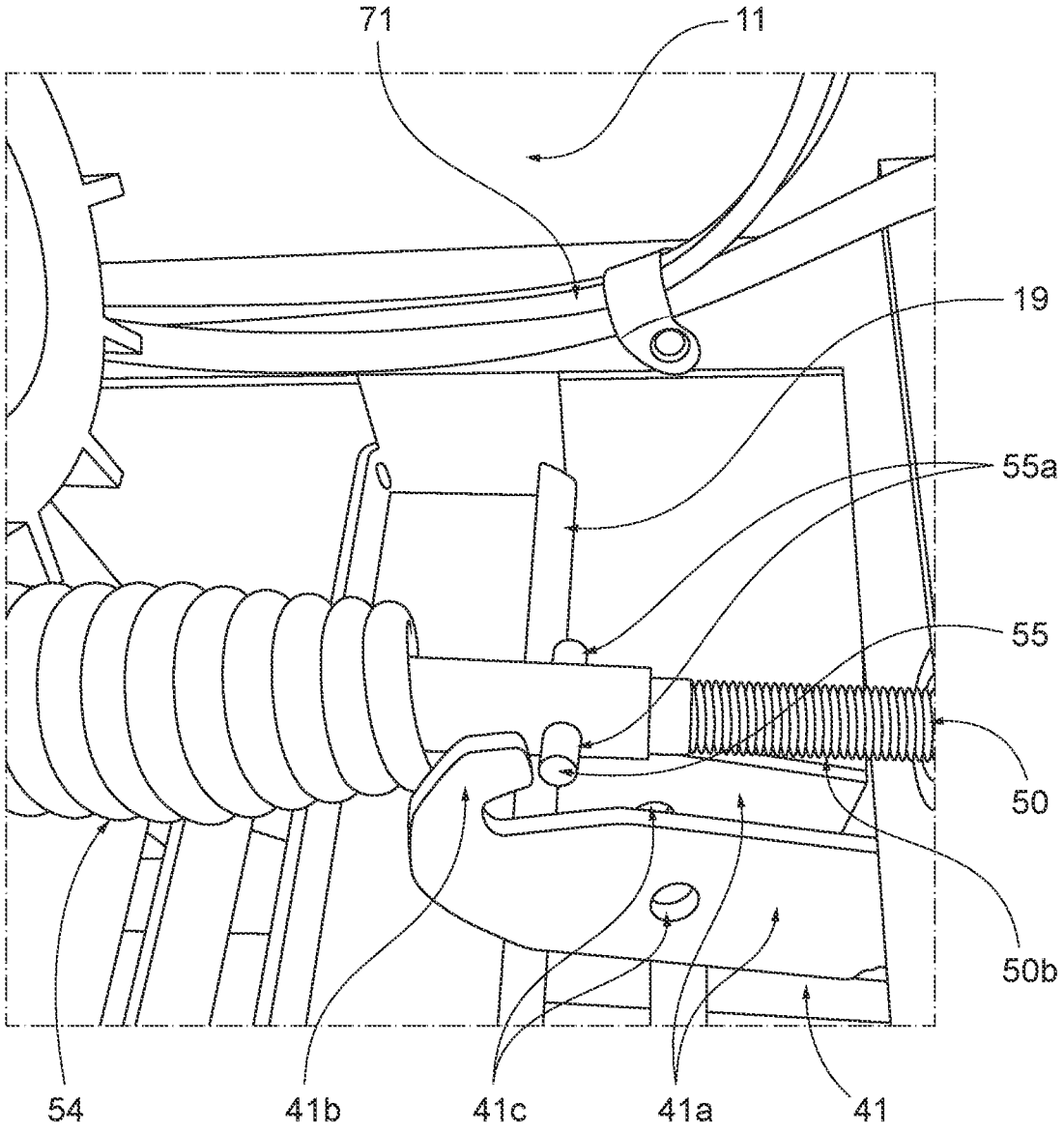
FIG. 11 is a close up interior view of a trap machine showing a lever engaged to a tension bolt in a first position, according to an exemplary embodiment of the disclosed subject matter.

FIG. 11 is a close up interior view of the trap machine 1 showing lever 40 just prior to its engagement to tension bolt 50 in the first position, according to an exemplary embodiment of the disclosed subject matter. In this view, first end 50*a* of bolt 50 is disposed inside of coil tensioning spring 54. A rod 55 is disposed in a through-hole passing through bolt 50 proximate to the first end 50*a* such that two ends 55*a* are disposed on opposing sides of bolt 50. First end 41 of lever 40 is shown oriented generally horizontally such that projections 41*a* flank bolt 50. Hooks 41*b* on each projection 41*a* are disposed to engage ends 55*a* of rod 55. Pulling the end 41 toward the rear of the trap machine 1 (rightward in this view) engages the hooks 41*b* to ends 55*a* such that they wrap partially around ends 55*a*.

Figure 12:
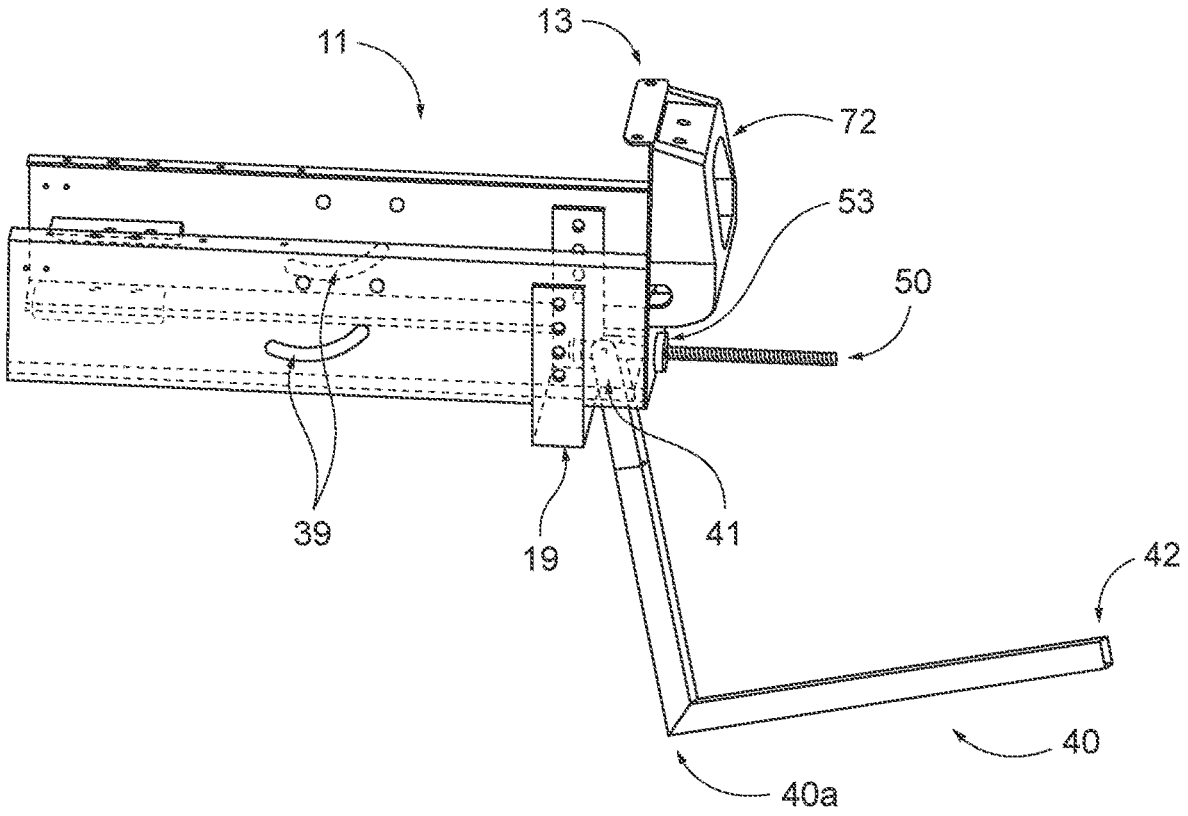
FIG. 12 is a side view of a trap machine showing a lever engaged to a tension bolt in a second position, according to an exemplary embodiment of the disclosed subject matter.

FIG. 12 is a simplified side view of a trap machine 1 according to an exemplary embodiment of the disclosed subject matter, showing lever 40 engaged to tension bolt 50 in a first position. In this view, housing lower body 11 is shown as transparent to allow its interior to be shown. In this second position, lever 40 engages bar 19 between first end 41 and bend 40*a* proximate to first end 41, and second end 42 is moved downward to an approximately horizontal orientation relative to the trap machine 1. The bend 40*a* causes the first end 41 to pivot rearward (to the right in this view) and cause first end 41 of lever 40 engaged to bolt 50 proximate to the first end 50*a* to be in a generally vertical orientation when second end 42 is moved downward.

Figure 13:
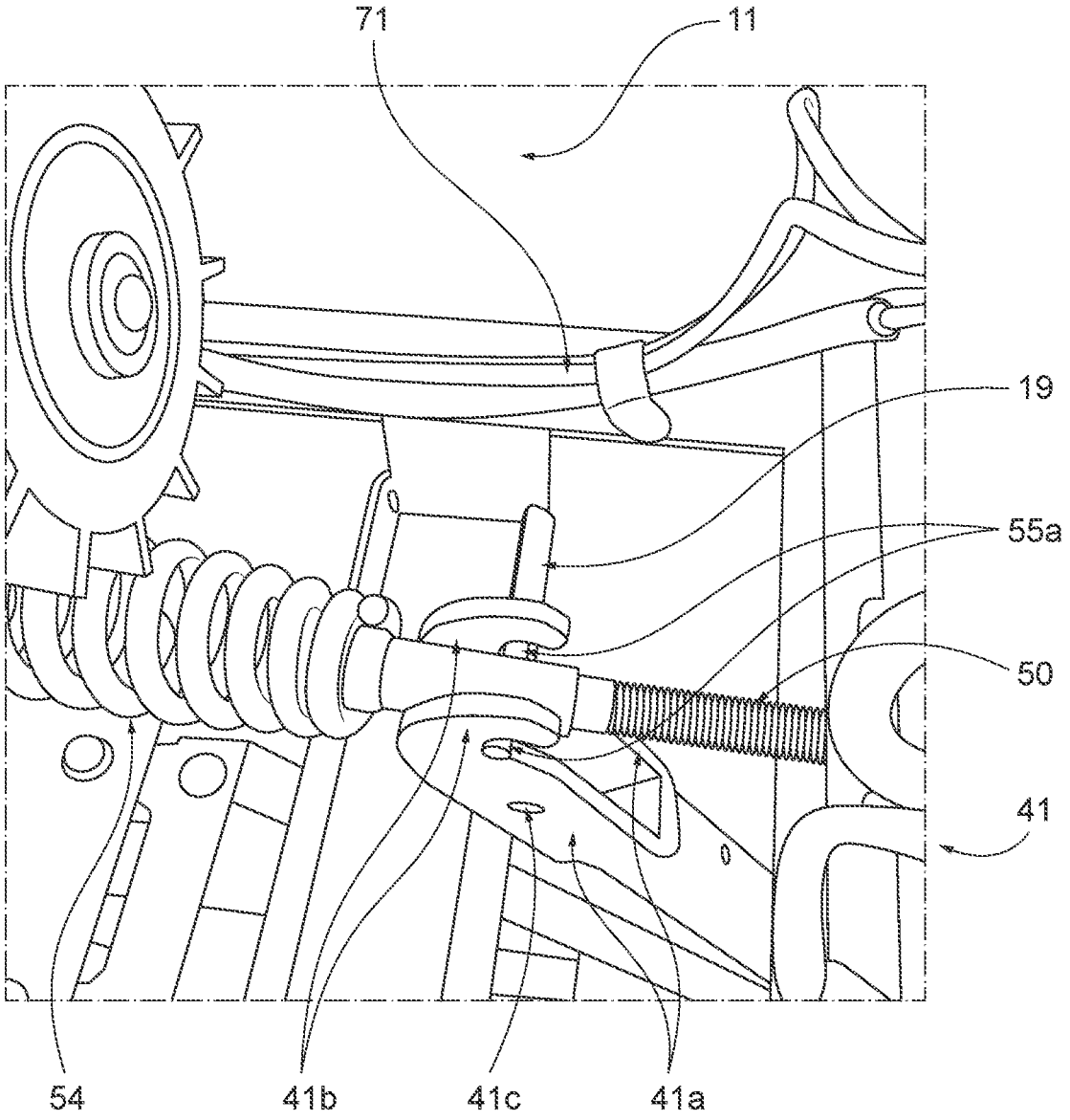
FIG. 13 is a close up interior view of a trap machine showing a lever engaged to a tension bolt in a second position, according to an exemplary embodiment of the disclosed subject matter.
Figure 14:
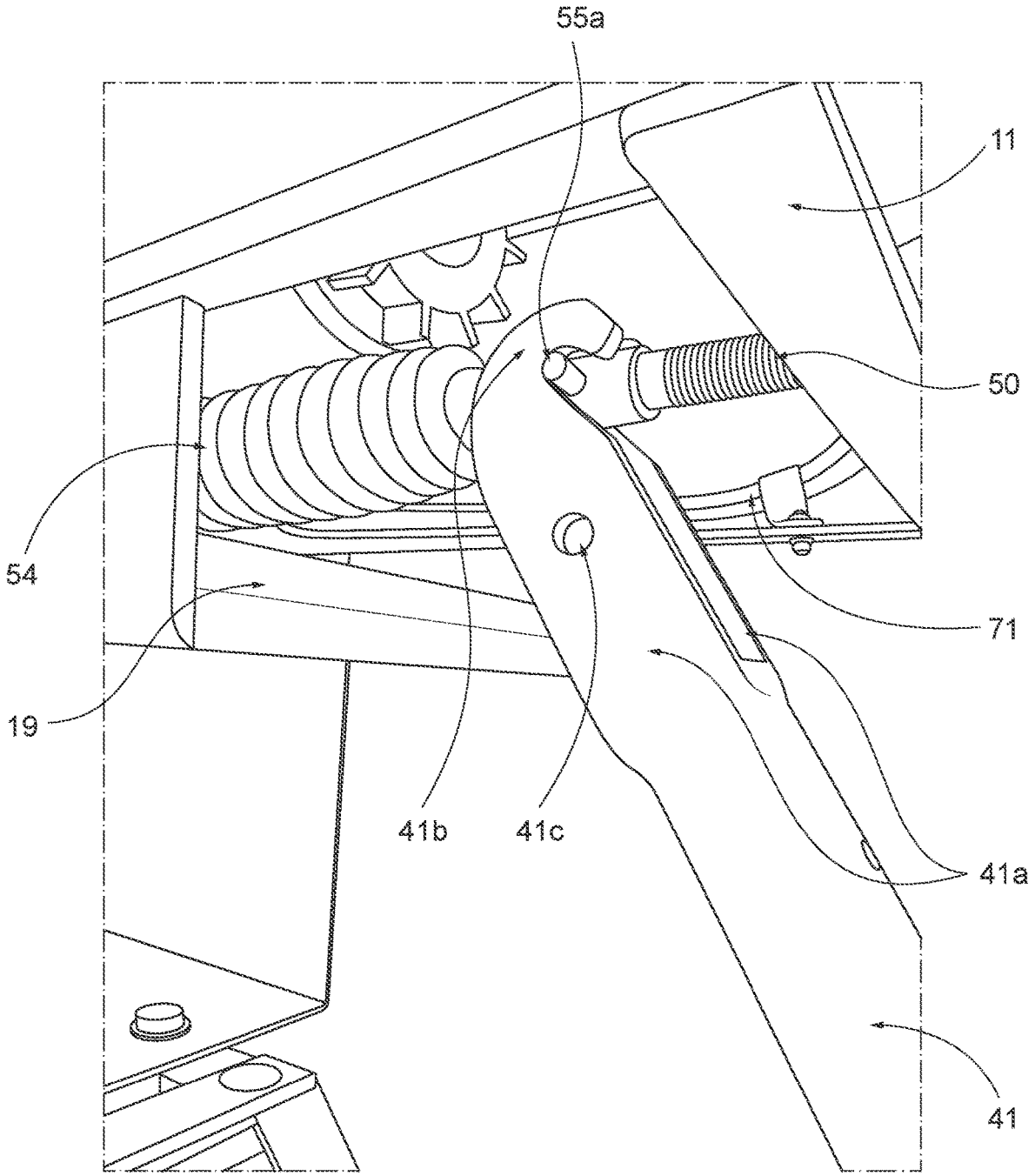
FIG. 14 is a close up interior view of a trap machine showing a lever engaged to a tension bolt in a second position, according to an exemplary embodiment of the disclosed subject matter.

FIG. 13 is a close up interior view of the trap machine 1 showing lever 40 after its engagement to tension bolt 50 and moved to a second position, according to an exemplary embodiment of the disclosed subject matter. One can see that coil spring 54 is expanded relative to that shown in FIG. 11.

In the second position, tension force between the spring and the threaded region 50*b* of bolt 50 is relieved and is transferred to the lever 40. A nut (not shown) when engaged to threaded region 50*b* of bolt 50 would not be held tightly against bushing 53 and could be easily screwed along threaded region 50*b* in either direction.

Moving the nut distally away from end 50*a* of bolt 50 while the lever 40 is in the second position allows sufficient distance so that when lever 40 is returned to its first position and first end 41 is disengaged from bolt 40, the spring 54 can be fully relaxed and there is no tension between spring 54 and bolt 50.

In embodiments, the trap machine 1 is configured so that when the spring is not under tension, the throwing arm is configured to be rotated and optionally engaged to a pin 18 attached to the housing so that the throwing arm 20 is disposed and held within the housing 10. The absence of tension in the spring 54 allows the throwing arm to be rotated into the slot 14 of housing 10 such that it is protected during transport and storage. Because there is no tension in the spring 54, accidental rotational movement of the throwing arm is minimized. These factors provide improved safety and durability of the disclosed trap machine over conventional trap machines. In embodiments, the pin 18 is attached to the top panel 12 of the housing and passes through a hole in the top panel 12 and into a hole in the distal end 20*a* of the arm 20. It can be spring-loaded to be held in a first position outside slot 14 so that throwing arm 20 can rotate freely. In a second position, it extends into the slot 14 and holds the throwing arm 20 inside housing 10.

When a user wants to operate the trap machine 1, the user can release the pin 18 engaging the throwing arm 20 allowing it to be rotated out of the housing 10. The user can reengage the lever 40 to the bolt 50 in the first lever position, and move the lever to its second position, thereby causing the bolt 50 to be moved rearward, causing the spring 54 to expand and reinstate tension in the tensioning assembly. A nut engaged to threaded region 50*b* can be moved proximally toward end 50*a* of bolt 50. In embodiments, the threaded bolt 50 comprises one or more positions or set points on the threaded region 50*b* configured that when the nut is positioned at the one or more positions, the spring can be brought under tension and the tension is proportional to a desired distance for the throwing arm to throw the clay target. Preferably, the nut can be moved to a desired set point while the lever 40 is engaged to the bolt 50 in its second position so that the nut can be moved easily by hand turning. Returning the lever 40 to its first position causes the bolt 50 to move toward the interior of lower body 11 and the nut engaged thereto is moved to engage bushing 53 on the rear panel 13. The spring 54 is brought to its desired tension for throwing a clay target.

In embodiments, the threaded bolt 50 is machined so that it comprises a flat side that does not comprise threads. Indicia on the flat side can provide markings aligned with one or more set points on the threaded region 50*b* proportional to a desired throw distance such as 50 yards, 60 yards and/or 70 yards. Alternatively or additively, the pitch of the screw threads can be changed in one or more portion of the threaded region 50*b* such that an altered rotation of a nut on the threaded region 50*b* corresponds to the one or more set points proportional to a desired throw distance.

Having described embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A clay target launching machine comprising a motor assembly;

a throwing arm operatively coupled to the motor assembly such that actuation of the motor assembly is translated into pivoting of the throwing arm to launch a clay target;

a housing that supports, at least in part, the motor assembly and the throwing arm;

a threaded bolt slidably disposed within the housing having a first end and a threaded second end, the threaded second end passing through a hole in a rear of the housing and a nut engaged to the second threaded end;

a tensioning spring having a first end and a second end, the first end operatively connected to the motor assembly and the second end engaged to the first end of the threaded bolt; the tensioning spring providing tension on the nut against the rear of the housing; and a lever configured to releasably engage the threaded bolt and move the threaded bolt against a bias of the tensioning spring thereby releasing tension of the nut against the rear of the housing.

2. The clay target launching machine of claim 1, wherein the lever comprises a first end configured to releasably engage the threaded bolt and a fulcrum on the housing and a second end comprising a handle; wherein the lever is configured to pivot about the fulcrum on the housing from a first position to a second position.

3. The clay target launching machine of claim 2, wherein the first end of the threaded bolt comprises two projections on opposed sides of the first end and the first end of the lever is configured to releasably engage the two projections on opposed sides of the first end of the threaded bolt.

4. The clay target launching machine of claim 3, wherein the first end of the lever comprises two projections, each having a hook configured to engage one of the two projections on the first end of the threaded bolt.

5. The clay target launching machine of claim 2, wherein the threaded second end of the threaded bolt and engages the rear of the housing with the nut engaged to the threaded second end of the threaded bolt and wherein when the lever is engaged to the first end of the threaded bolt and moved from the first position to the second position, the tensioning spring is extended and tension between the threaded bolt and the rear of the housing is reduced, allowing for the nut to be moved distally along the threaded bolt and disengaged from the rear of the housing.

6. The clay target launching machine of claim 5 wherein when the nut has been moved distally along the threaded rod and the lever is returned to its first position, the spring is not under tension.

7. The clay target launching machine of claim 2 wherein when the first end of the lever is not engaged to the threaded bolt, it is configured to engage a socket in a wheeled cart supporting the housing to provide a handle for moving the wheeled cart.

8. The clay target launching machine of claim 1 wherein the threaded bolt comprises a flat side that does not comprise threads.

9. The clay target launching machine of claim 1 wherein the threaded bolt comprises one or more positions on the threaded bolt configured that when the nut is positioned at the one or more positions, the spring is under tension and the tension is proportional to a desired distance for the throwing arm to throw the clay target.

10. The clay target launching machine of claim 1 wherein when the spring is not under tension, the throwing arm is configured to be rotated and engaged to a rod attached to the housing so that the throwing arm is disposed and held within the housing.

11. The clay target launching machine of claim 1 wherein the nut comprises a knurled handle or a speed ball handle.

12. A method for reducing tension in a tensioning spring of a clay target throwing machine, the method comprising:

providing a clay target throwing machine according to claim 1;

engaging the first end of the lever to the first end of the threaded bolt and a fulcrum on the housing at a first position;

moving the lever from the first position to a second position, thereby extending the tensioning spring and reducing tension between the threaded bolt and the rear of the housing, allowing for the nut to be moved distally along the threaded bolt and disengaged from the rear of the housing; and moving the lever from the second position back to the first position, thereby reducing tension in the tensioning spring.

13. The method of claim 12 further comprising disengaging the first end of the lever from the first end of the threaded bolt and the fulcrum on the housing.

14. The method of claim 12 further comprising rotating the throwing arm so that the throwing arm is disposed within the housing.

15. The method of claim 14 further comprising engaging the throwing arm to a rod attached to the housing so that the throwing arm is held within the housing.

16. The method of claim 12 wherein the first end of the threaded bolt comprises two projections on opposed sides of the first end and the first end of the lever is configured to releasably engage the two projections on opposed sides of the first end of the threaded bolt.

17. The method of claim 16 wherein the first end of the lever comprises two projections, each having a hook configured to engage one of the two projections on the first end of the threaded bolt.

* * * * *